US006210214B1

(12) United States Patent
Chang

(10) Patent No.: US 6,210,214 B1
(45) Date of Patent: Apr. 3, 2001

(54) STACKED MODULAR JACK CONNECTOR ASSEMBLY

(75) Inventor: Yao-Hao Chang, Chung-Ho (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/469,151

(22) Filed: Dec. 21, 1999

(51) Int. Cl.[7] ..... H01R 13/514
(52) U.S. Cl. ..... 439/541.5
(58) Field of Search ..... 439/541.5, 79

(56) References Cited

U.S. PATENT DOCUMENTS 5,531,612 * 7/1996 Goodall et al. ..... 439/541.5
5,709,554 * 1/1998 Savage, Jr. ..... 439/541.5
5,725,385 * 3/1998 Takano et al. ..... 439/541.5
6,019,631 * 2/2000 Chen ..... 439/541.5

* cited by examiner

*Primary Examiner*—Gary F. Paumen
(74) *Attorney, Agent, or Firm*—Wei Te Chung

(57) ABSTRACT

An electrical connector comprises a first jack and a second jack stacked in the first jack. The first jack includes an upper section from which a pair of lead-ins downwardly projecting, a lower section, and a number of first terminals. The lower section comprises a pair of openings, a number of toes projecting forwardly from an underside thereof, and a number of recesses spaced by the toes. The second jack having a number of second terminals defines a pair of channels engaging with the lead-ins, a pair of latches rearwardly extending for cooperating with the openings, a number of projections and a number of grooves in an underside thereof spaced by the projections. Some of the second terminals are secured between corresponding recesses and projections and the other second terminals are secured between corresponding grooves and toes.

2 Claims, 4 Drawing Sheets

STACKED MODULAR JACK CONNECTOR ASSEMBLY

BACKGROUND OF THE INVENTION

1. Field of the Invention

The present invention relates to a connector assembly, and more particularly to a stacked modular jack connector assembly in which two modular jacks are mirror-image arranged.

2. Brief Description of the Prior Art

U.S. Pat. No. 5,531,612 discloses a conventional modular jack connector assembly. The modular jack connector assembly comprises a common main housing and a plurality of modular jack connectors mounted within the main housing. The modular jack connectors are provided in upper and lower rows in a substantially mirror image disposition. The main housing is integrally formed. Each modular jack has an insert assembly which is consisted of a first over-moulded portion for securing engaging ends of contacts thereof and a second over-moulded portion for securing soldering tails of the contacts thereof.

It can be seen that the conventional connector requires extra manufacturing of the insert assemblies thereof. Moreover, the integral main housing makes the conventional connector can not be adapted for different mounting panels.

Hence, an improved electrical connector is required to overcome the disadvantages of the prior art.

BRIEF SUMMARY OF THE INVENTION

A first object of the present invention is to provide a modular jack connector assembly with a retention means reliably spacing and retaining a plurality of terminals thereof; and A second object of the present invention is to provide a modular jack connector assembly with a retention means facilitating an assembly thereof.

To achieve the above-mentioned objects, a modular jack connector assembly includes a first jack overlapping on a second jack. The first jack has a first housing and a plurality of first terminals extending through the first housing. The first housing is consisted of an upper section and a lower section offsetting from the upper section whereby defining a space. The lower section defines a pair of openings, a plurality of partitions at an underside thereof and a plurality of spaced recesses divided by the partitions. A plurality of integrally formed toes projects forwardly from an underside of the lower section. The upper section has a pair of lead-ins downwardly projecting from a bottom side thereof.

The second jack includes a housing, a plurality of second terminals extending through the housing, a pair of channels at lateral sides of a top end thereof, a pair of latches extending from a rear side thereof, a plurality of projections extending rearwardly from a rearward underside thereof, and a plurality of grooves defined by the projections. Some of the second terminals extend along the partitions while other second terminals bend inwardly into the grooves. The latches and the partitions are integrally formed with a housing of the second jack.

In assembly, the second jack is inserted into the space by means that the channels slide along the lead-ins to guide and secured the second jack. The latches then extend into the openings. As a result, the projections fit with the recesses and the grooves mate with the toes whereby the second terminals are reliably positioned between corresponding projections and recesses or between corresponding toes and grooves. The connector is finally mounted onto a circuit board.

Other objects, advantages and novel features of the invention will become more apparent from the following detailed description of the present embodiment when taken in conjunction with the accompanying drawings.

DETAILED DESCRIPTION OF THE INVENTION

Figure 1:
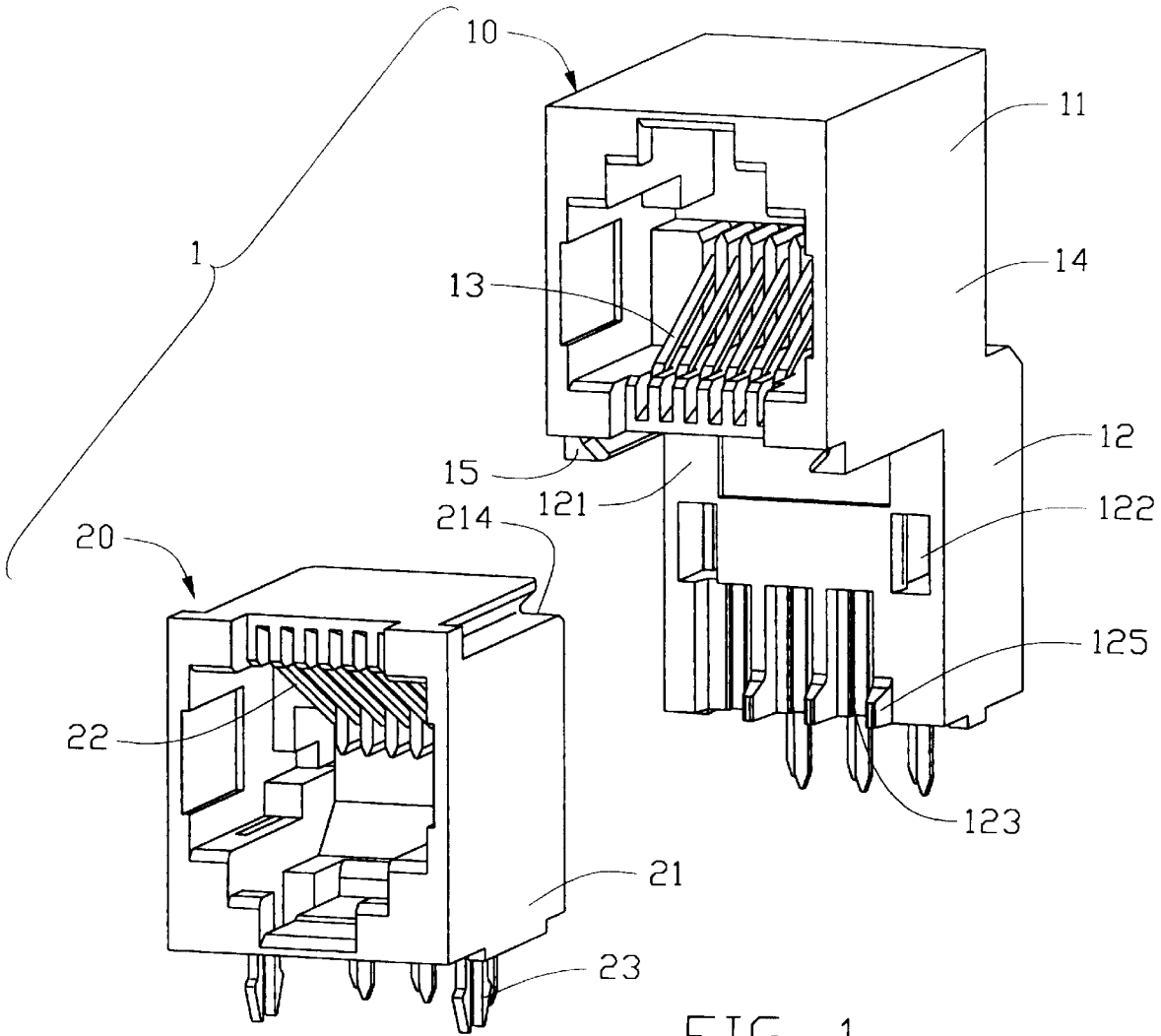
FIG. 1 is a partial exploded view of a modular jack connector assembly of the present invention.

Referring to FIG. 1, an electrical connector 1 of the present invention comprises a first jack 10 and a second jack 20. The modular jacks are mirror-image arranged in upper and lower positions.

The first jack 10 has a dielectric first housing 14 which is consisted of an upper section 11 and a lower section 12 offsetting rearwardly from the upper section 11 thereby defining a space (not labeled) such that the second jack 20 can be accommodated in the space (not labeled). The first jack 10 further includes a plurality of first terminals 13 extending downwardly through the first housing 14 thereof and a pair of elongate lead-ins 15 projecting downwardly from a bottom side of the upper section 11. The lower section 12 defines a pair of openings 122 in lateral ends of a mating surface 121 thereof and a plurality of recesses 123 in an underside thereof. The lower section 12 defines grooves (not shown) on the back for holding tail sections of the first terminals in position. Oppositely, the lower section 12 also has a plurality of partitions 124 spacing the recesses 123 and a plurality of toes 125 projects forwardly from a lower end of the mating surface 121. The partitions 124 and the toes 125 are integrally formed with the first housing 14.

Figure 2:
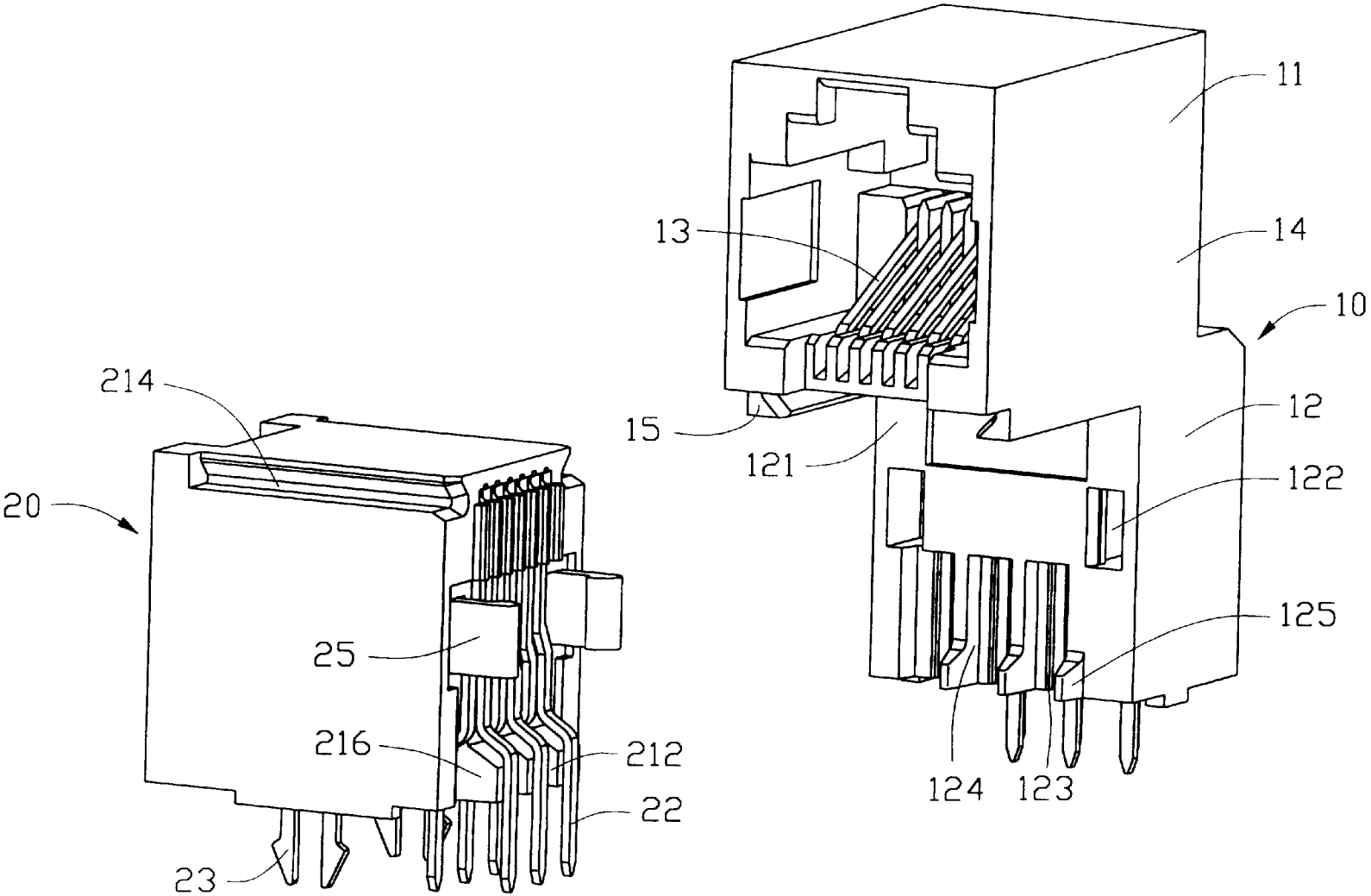
FIG. 2 is similar to FIG. 1 showing a rear side of a jack.

Further referring to FIG. 2, the second jack 20 includes a dielectric second housing 21, a plurality of second terminals 22 secured in the second housing 21, a pair of metallic board locks 23 depending downwardly from the second housing 21 for establishing a grounding connection with a circuit board (not shown), and a pair of latches 25 protruding rearwardly from a rear surface of the second housing 21. The plurality of second terminals 22 extends beyond the second housing 21 for contacting corresponding circuit traces on the circuit board (not shown). The pair of latches 25 is disposed at a rear side of the second housing 21 such that the latches 25 are engageable with corresponding openings 122 to attach the second jack 20 to the first jack 10. The pair of latches 25 is integrally made with the second housing 21. The second housing 21 further has a pair of channels 214 separated at lateral ends of a top end thereof and a plurality of projections 216 spaced at a rearward underside thereof which defines a plurality of grooves 212 therebetween. The projections 216 are integrally formed with the second housing 21. The channels 24 are positioned accordingly to the lead-ins 15 of the first jack 10 so that the channels 24 can be leaded by and then fixed between the lead-ins 15 whereby attaching the second jack 20 to the first jack 10. Every other second terminals 22 extend along a rear side of the second housing 21 and over the projections 216 while the else second terminals 22 extend along the rear side of the second housing 21 and then bend inwardly into the plurality of grooves 212.

Figure 3:
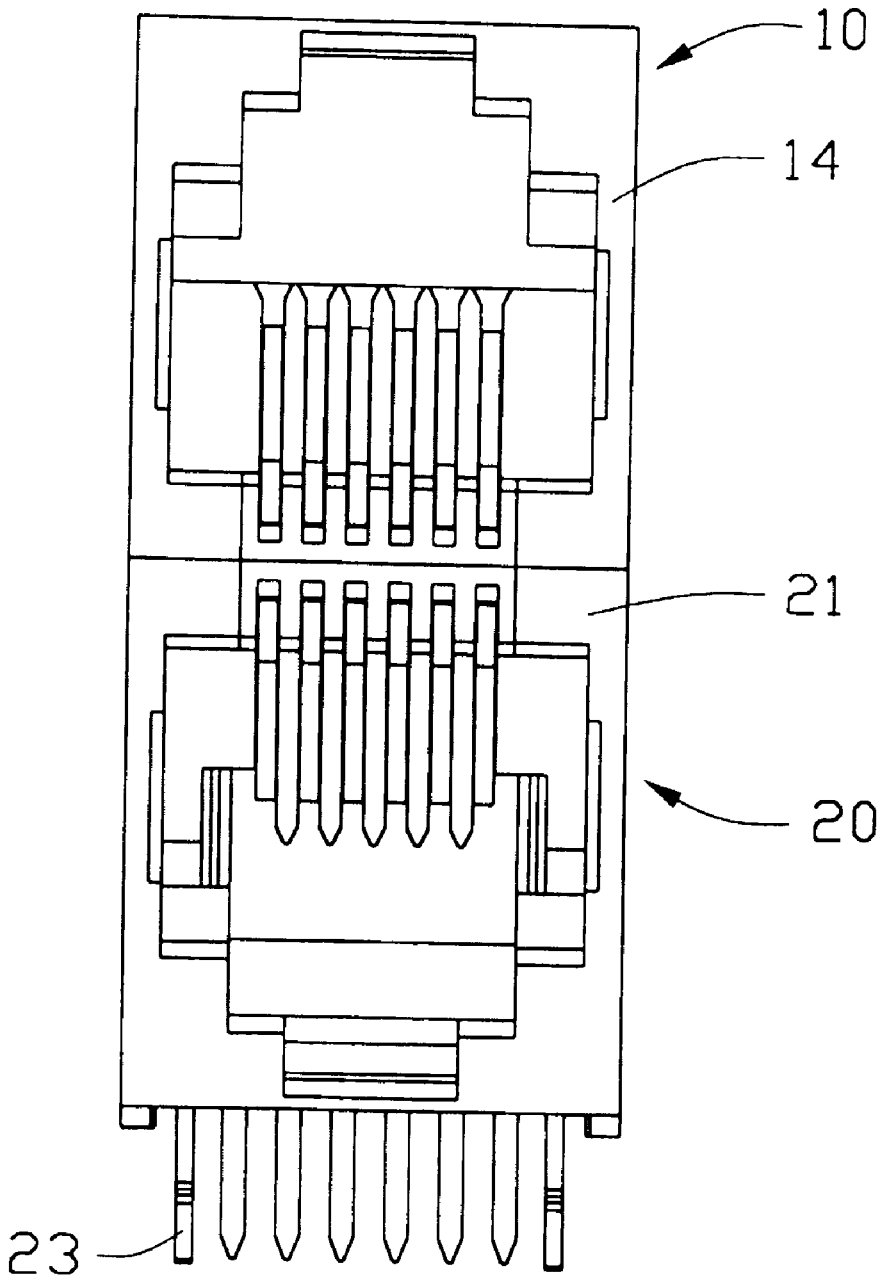
FIG. 3 is a front view of an assembled assembly of FIG. 1.
Figure 4:
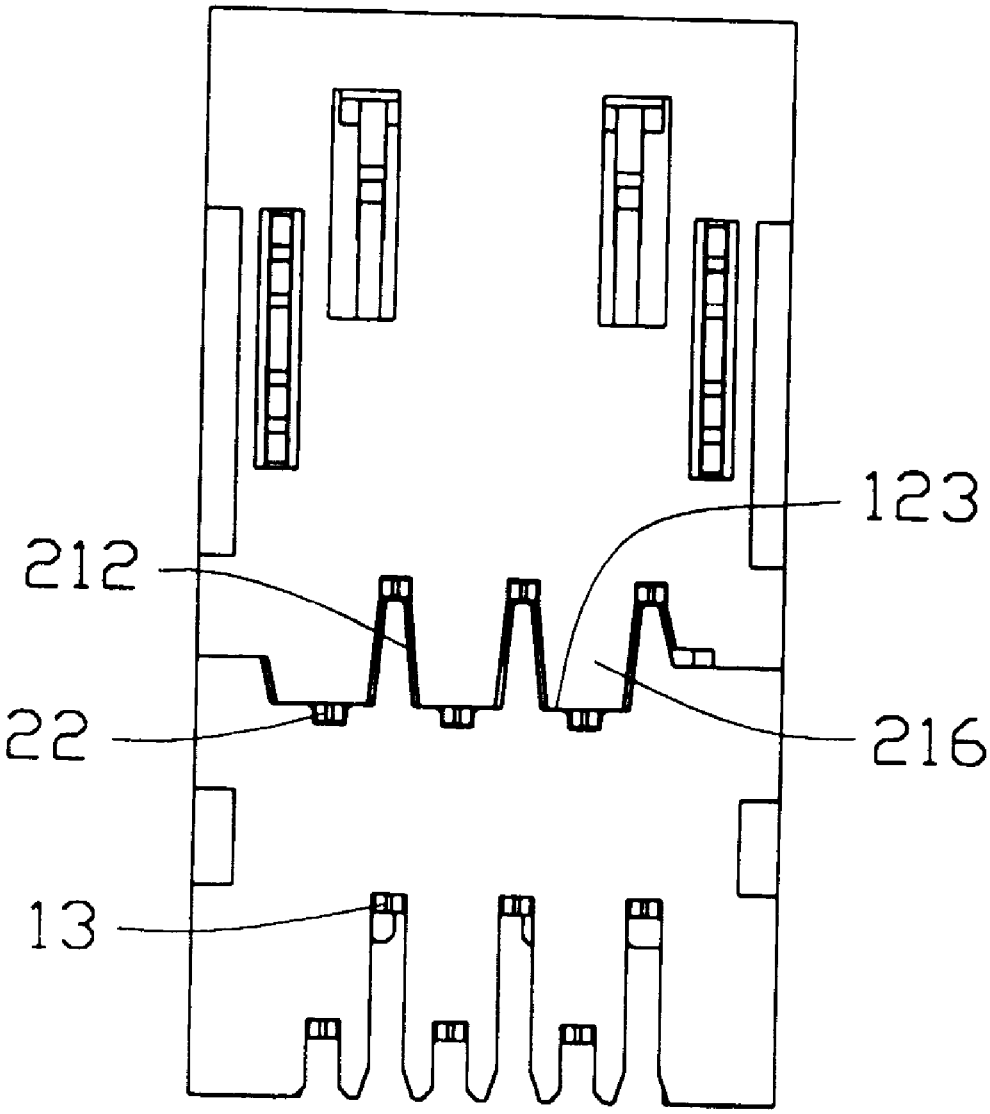
FIG. 4 is a bottom view of the assembled assembly FIG. 3.

In assembly, referring to FIGS. 3 and 4, the second jack 20 is inserted rearwardly from a front of the first jack 10 to be accommodated in the space (not labeled) by means of the channels 214 being guided by the lead-ins 15. The pair of latches 25 then extends into the openings 122 of the lower section 12 to attach the second jack 20 into the first jack 10 while the projections 216 are aligned with corresponding recesses 123 of the lower section 12. The projections 216 thus engage with corresponding recesses 123 thereby securing some second terminals 22 which extend along the projections 216 between the recesses 123 and the projections 216. While the plurality of projections 216 extends into the recesses 123, the grooves 212 mate with corresponding toes 125 thereby fixing other second terminals 22 between the grooves 212 and the toes 125. Finally, the connector 1 is mounted on the circuit board (not shown) by means that the exposed ends of the first terminals 13 and the second terminals 22 fit into corresponding through holes in the circuit board (not shown) and the pair of board locks 23 latches to the circuit board (not shown). It can be see that the assembly of the connector 1 is so facilitated.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a first jack including a dielectric housing and a plurality of first terminals received in the housing, the dielectric housing consisting of an upper section and a lower section, the lower section having a plurality of toes projecting from a front lower end thereof and a plurality of recesses at the front lower end between the toes thereof; and a second jack secured to the first jack under the upper section, the second jack including a dielectric housing, a plurality of second terminals received in the housing, a plurality of projections extending from a rear lower end thereof, and a plurality of grooves alternatingly disposed between the projections, some of the second terminals extending over the projections and being secured between the recesses and the projections, other second terminals extending into the grooves and being secured between the grooves and the toes;

wherein the projections and the toes are integrally formed with the second and first housings, respectively;

wherein the first jack has a pair of lead-ins downwardly projecting therefrom for guiding the second jack during assembly;

wherein the second jack has a pair of channels at a top side thereof for securing to the lead-ins;

wherein the lower section of the first jack defines a pair of openings at lateral sides thereof;

wherein the second jack has a pair of latches for mating with the openings to attach the second jack to the first jack.

2. A modular jack connector assembly, comprising:

a first housing defining upper and lower sections, the upper and lower sections being offset from each other such that a space is defined below the upper section;

a plurality of first terminals received in the first housing;

a second housing securely received in the space;

a plurality of second terminals received in the second housing; and first interlocking means between the first and the second housings for fixedly attaching the second housing to the first housing in vertical and lateral directions thereof, and second interlocking means between the first and the second housings for fixedly attaching the second housing to the first housing in a front-to-back direction thereof;

wherein said lower section defines means for holding both the first terminals and the second terminals therein;

wherein said first interlocking means includes a wedge-slot in a top surface of the second housing and a wedge engageable with the wedge-slot and extending downwardly from a bottom surface of the upper section;

wherein said second interlocking means includes a pair of latches protruding rearwardly from a rear surface of the second housing, and a pair of openings defined in a front face of the lower section of the first housing;

wherein the lower section further comprises a plurality of toes projecting from a front lower end thereof and a plurality of recesses at the front lower end between the toes thereof, and the second housing comprises a plurality of projections extending from a rear lower end thereof and a plurality of grooves alternatingly disposed between the projections;

wherein some of the second terminals extend over the projections and are secured between the corresponding recesses and projections, and wherein the other second terminals extend into the grooves and are secured between the corresponding grooves and toes;

wherein the projections and the toes are integrally formed with the second and first housings, respectively.

* * * * *